US011516900B2

(12) United States Patent
Angelin et al.

(10) Patent No.: US 11,516,900 B2
(45) Date of Patent: Nov. 29, 2022

(54) METHOD OF DRIVING LIGHT SOURCES, AND CORRESPONDING DEVICE AND SYSTEM

(71) Applicant: OSRAM GmbH, Munich (DE)

(72) Inventors: Francesco Angelin, Mogliano Veneto (IT); Alessio Griffoni, Fosso (IT)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 17/336,324

(22) Filed: Jun. 2, 2021

(65) Prior Publication Data

US 2021/0385920 A1 Dec. 9, 2021

(30) Foreign Application Priority Data

Jun. 3, 2020 (IT) ..... 102020000013171

(51) Int. Cl.
*H05B 45/325* (2020.01)
*H05B 45/10* (2020.01)
*H05B 45/335* (2020.01)

(52) U.S. Cl.
CPC ..... *H05B 45/325* (2020.01); *H05B 45/10* (2020.01); *H05B 45/335* (2020.01)

(58) Field of Classification Search
None
See application file for complete search history.

(56) References Cited

U.S. PATENT DOCUMENTS

2007/0103086 A1 5/2007 Neudorf et al.
2009/0303161 A1 12/2009 Messmer et al.
2014/0103830 A1* 4/2014 Lin ..... H05B 45/14 315/210
2016/0057823 A1 2/2016 Pope et al.
2016/0212813 A1* 7/2016 Li ..... H05B 45/3725

FOREIGN PATENT DOCUMENTS

DE 202017002443 U1 8/2018
DE 202017002443 U1 * 9/2018 ..... H05B 45/38

OTHER PUBLICATIONS

Search Report issued for the corresponding Italian Patent Applicaiton No. IT 202000013171, dated Jan. 25, 2021, 9 Pages.

* cited by examiner

*Primary Examiner* — Dedei K Hammond
(74) *Attorney, Agent, or Firm* — Viering Jentschura & Partner MBB

(57) ABSTRACT

A method for driving one or more electrically powered light sources, such as LED modules, may include applying a pulse-width-modulated signal thereto having a pulse-repetition frequency and a duty-cycle, the duty-cycle being selectively variable in order to vary the intensity of light emitted by the light source or light sources. To counter the occurrence of temporal light artefacts, or TLAs, the method may include frequency modulating the pulse-width-modulated signal ($V_{PWM}$) by varying the pulse-repetition frequency thereof around a certain value between a lower frequency value and a higher frequency value, thus giving rise to a signal with combined FM/PWM modulation.

9 Claims, 4 Drawing Sheets

METHOD OF DRIVING LIGHT SOURCES, AND CORRESPONDING DEVICE AND SYSTEM

CROSS-REFERENCE TO RELATED APPLICATION

The present patent application claims priority, according to 35 U.S.C. § 119, from Italian Patent Application No. 102020000013171 filed on Jun. 3, 2020, the entire disclosure of which is incorporated herein by reference.

TECHNICAL FIELD

The present disclosure relates to lighting apparatuses.

One or more embodiments may find use, for example, in lighting systems that use electrically powered solid-state light sources, for example LED sources.

BACKGROUND

The rate at which solid-state lighting (SSL) sources can change the intensity of the light radiation emitted is one of the main drivers underlying the revolution that we are witnessing in the world of lighting and lighting applications.

Linked to the rate at which it is possible to change the intensity of the light radiation emitted is the direct transfer, whether desired or not, of the modulation of the driving current into a modulation of the luminous flux emitted.

This light modulation can give rise to changes in the perception of the environment.

In some applications, such as very specific entertainment, scientific, or industrial applications, such a change of perception due to modulation of the light may be a desired effect.

For the majority of applications and daily activities such a change may, instead, be detrimental and undesirable.

The general term used for identifying these changes in perception of the environment is "temporal light artefacts" (TLAs): these artefacts can have a significant influence on how the quality of the light is appreciated. Moreover, a visible modulation of the light can lead to reduction in performance, increased fatigue, and health problems, such as epileptic convulsions and episodes of migraine.

Different terms exist to describe the different types of TLAs that can be perceived by humans.

The term "flicker" refers to the variation of light that can be directly perceived by an observer.

By "stroboscopic effect" is meant an effect that may become visible for an observer when a moving or rotating object is illuminated (CIE TN 006: 2016).

Possible causes of modulation of the light emitted by lighting apparatuses that may give rise to flicker or stroboscopic effects comprise:

AC power supply combined with the technology of the light source and its control-gear topology;

dimming technology (dimming of the intensity) applied using external dimmers or integrated light-level regulators; and mains-voltage fluctuations caused by electrical apparatuses connected to the mains (conducted electromagnetic disturbance) or applied intentionally for mains-signalling purposes.

Lighting products that present an unacceptable stroboscopic effect are considered of poor quality.

For flicker the parameter referred to as "short-term flicker severity" or $P_{st}^{LM}$ is used, standardized at the IEC level, which derives from the standardized $P_{st}$ metric widely applied and accepted to assess the impact of voltage fluctuations on flicker (see IEC TR 61547-1).

For objective assessment of the stroboscopic effect, the stroboscopic-effect visibility measure (SVM) is described in the IEC TR 63158 standard via a Minkowski metric, namely as:

$$SVM = \sqrt[3.7]{\sum_{i=1}^{+\infty} \left(\frac{C_i}{T_i}\right)^{3.7}}$$

where:

$C_i$ is the relative amplitude of the i-th Fourier component (trigonometric representation of the Fourier series) of the relative illuminance $I_i$ (with respect to the DC level); and $T_i$ is the visibility threshold of the stroboscopic effect for a sinusoidal wave at the frequency of the i-th Fourier component.

The visibility-threshold function T(f), also referred to as stroboscopic-effect contrast-threshold function, identifies the relative amplitude of a sinusoidal modulation in addition to a constant illuminance level that is just visible with a probability of 50% for an average observer.

This function has been defined in CIE TN 006: 2016 by the following equation:

$$T(f) = \frac{1}{1 + \exp(-0.00518 \cdot (f - 306.8))} + 20 \cdot \exp\left(-\frac{f}{10}\right)$$

where f is the frequency in hertz.

In CIE TN 006: 2016, the visibility-threshold function is defined up to 2000 Hz. The reason is that, in common lighting applications, for modulation frequencies above 2000 Hz, no stroboscopic effect can be perceived. Consequently, also the summation of the spectral components is limited to 2000 Hz (see IEC TR 63158).

However, limiting the summation of the spectral components over such a frequency range may cause some anomalies in the calculation of SVM values in the case where the spectrum of a waveform extends beyond 2000 Hz.

To avoid such anomalies, in Perz, M., et al.: "Invited Paper: Modelling Visibility of Temporal Light Artefacts" SID Symposium Digest of Technical Papers. 49. 1028-1031. 10.1002/sdtp.12194 the definition of this visibility-threshold function has been extended above 2000 Hz, as follows:

$$T(f) = 2.865 \cdot 10^{-5} \cdot f^{1.543} + 0.225 + 20 \cdot \exp\left(-\frac{f}{10}\right)$$

The conventional existing stroboscopic-effect contrast-threshold (stroboscopic visibility threshold or SVT) function and the new one are represented in FIG. 1, by a dashed line (I) and a solid line (II), respectively, as a function of the frequency f (in hertz).

In the figure it may be seen that the existing threshold function (dashed line I) is only defined up to 2000 Hz, whereas the extended threshold function (solid line II) is defined also above 2000 Hz. It may also be seen that for the existing threshold function (dashed line I) the asymptotic value close to 2000 Hz becomes a constant close to the value 1.

This is a non-physical behaviour that does not match the fact that above 2000 Hz the stroboscopic effect is not visible. The extended threshold curve T(f) of the last equation seen previously shows a trend such that beyond 2000 Hz its value becomes very high, which means that waveforms at those modulation frequencies are not perceived as stroboscopic effect.

This is more in line with the practical experience of perception of the stroboscopic effect.

The European Commission Regulation, in the framework of "eco-design requirements", lays down eco-compatible design specifications for light sources and the supply sources associated thereto, envisaging for the SVM parameter a rather low limit (<0.4), which makes it not easy for constant-voltage (CV) SSL systems with PWM dimming to achieve compliance with the regulation, in particular when low dimming levels are used (e.g., below 10%).

It should be emphasised that the PWM dimming technique is based upon an on-off (full-depth) rectangular waveform. The harmonic content of such a modulation typically extends to high-order harmonics, thus comprising frequencies well above the "nominal" (carrier) frequency. The highest extent of these harmonics is related to the rise and fall times of the wave fronts. For a PWM with a pulse frequency of 1 kHz, it is common to reach components even higher than 10 kHz.

The contrast-threshold function is given for a sinusoidal light, and, when many components are present in the light analysed (according to the Fourier decomposition), a Minkowski norm given by the first equation provided previously is used for the SVM parameter.

Most of the electronic-control-gear units (ECGs) of a CV type perform PWM at a fixed frequency, which in general is equal to or lower than 1.0 kHz.

These devices, designed years ago, are far from compliant with the most recent regulations regarding TLAs. The minimum, non-modulated, frequency to achieve compliance is in fact approximately 2.5 kHz.

There do actually exist some ECGs that perform standard PWMs at frequencies higher than 2 kHz. This is the case, for example, of the products available from the company of the OSRAM group under the trade name OTi BLE 80/220, . . . , 240/24 1, . . . , 4 CH (2.01 kHz) (see osram.com) or from the company MeanWell under the trade name PWM-60-KN (up to 4 kHz) (see meanwell-web.com).

It may be noted that ECGs of this type may not be able to perform lamp-failure detection (e.g., according to DALI requirements), for example by exploiting a pulse-shift technique.

Furthermore, it may be noted that approximately 2 kHz is the highest usable frequency in order to achieve a reasonable propagation of the shortest PWM pulse through the longer cables, without the excessive distortion that causes uneven light distribution. Operating at higher frequencies to meet new specifications in terms of SVM militates against the possibility of extending the length of the cables of the system to values in the region of 20-50 m.

A document such as US 2016/057823 A1 provides an example of the prior art. Further documents of interest comprise DE 20 2017 002443 U1, US 2009/303161 A1, and US 2007/103086 A1.

SUMMARY

The object of one or more embodiments is to contribute to overcoming the drawbacks outlined above.

According to one or more embodiments, the above object can be achieved thanks to a method having the characteristics referred to in the ensuing claims.

One or more embodiments may regard a corresponding device (for example, a so-called electronic control gear or ECG for lighting systems).

One or more embodiments may regard a corresponding lighting system.

The claims form an integral part of the technical teachings provided herein in relation to the embodiments.

One or more embodiments facilitate achievement of one or more of the following advantages:

possibility of reaching SVM values in line with the most recent regulation;

reduced maximum and average frequency, with reduced distortion of the PWM pulse related to cable/module length and better end-to-end uniformity of the light in modules of considerable length; and possibility of using pulse-shift techniques for measuring the multi-channel current and detecting failures of the lamp, also for low dimming levels (<5%).

BRIEF DESCRIPTION OF THE DRAWINGS

One or more embodiments will now be described, purely by way of non-limiting example, with reference to the annexed drawings, wherein.

Identical, similar or equivalent elements are provided with the same reference signs in the figures. The figures and the proportions of the elements represented in the figures among each other are not to be considered as true to scale. Rather, individual elements may be oversized for better representability and/or for better comprehensibility.

DETAILED DESCRIPTION

In the ensuing description various specific details are illustrated in order to enable an in-depth understanding of various examples of embodiments according to the disclosure. The embodiments may be obtained without one or more of the specific details, or with other methods, components, materials, etc. In other cases, known structures, materials, or operations are not illustrated or described in detail so that the various aspects of the embodiments will not be obscured.

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment" or "in one embodiment" that may be present in various points of the present description do not necessarily refer exactly to one and the same embodiment. Moreover, particular conformations, structures, or characteristics may be combined in any adequate way in one or more embodiments.

The terms/references used herein are provided simply for convenience and hence do not define the sphere of protection or the scope of the embodiments.

Figure 1:
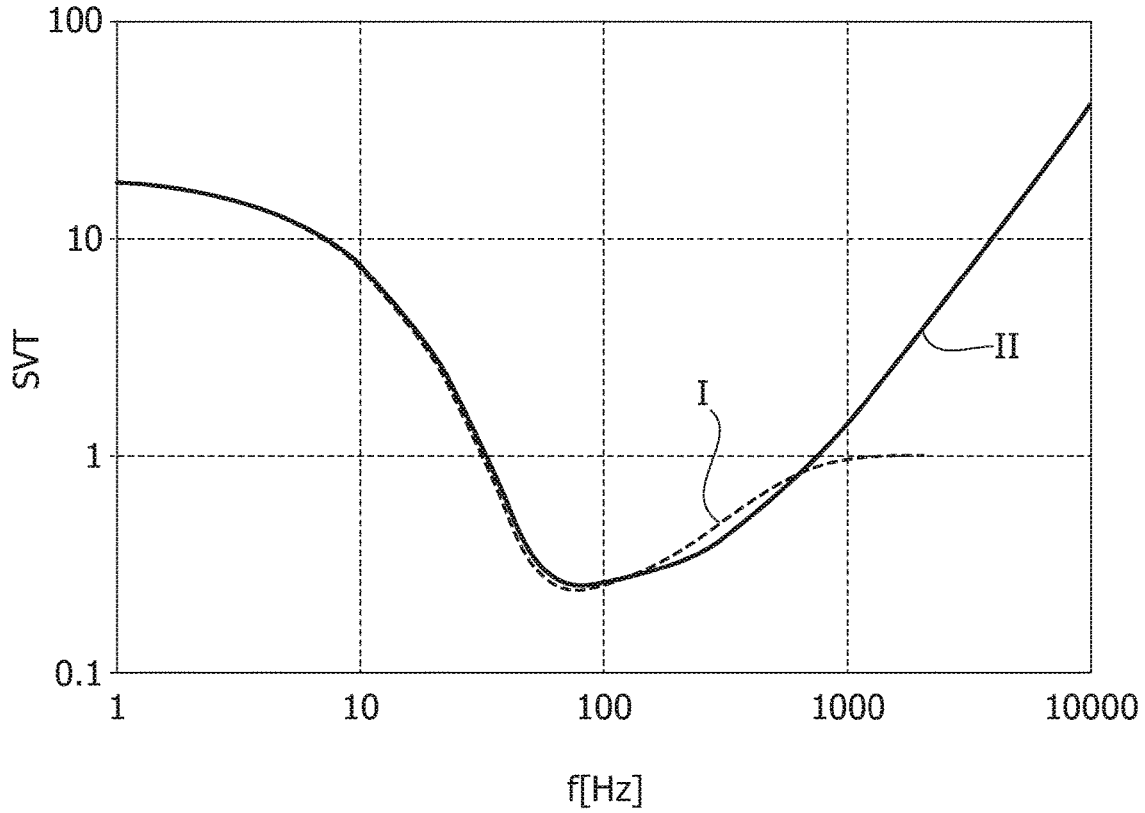
FIG. 1 has already been discussed previously.
Figure 2:
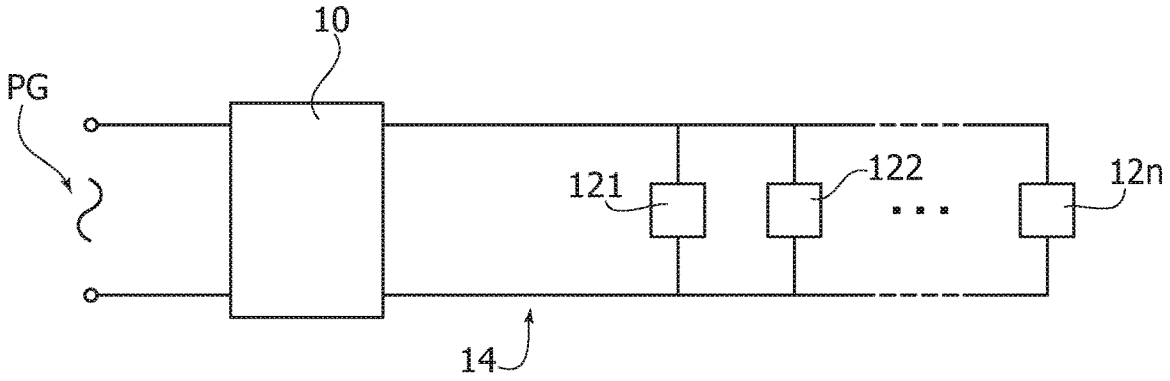
FIG. 2 is a block diagram of a lighting system.

FIG. 2 illustrates, by way of example, a solid-state lighting (SSL) system of the constant-voltage (CV) type.

As illustrated, such a system may comprise an electronic power supply (electronic control gear or ECG) 10 set between an electric power grid PG (for example, an AC mains supply or network) and one or more solid-state lighting modules 121, 122, . . . , 12*n* (for example, LED lighting modules).

In a system as illustrated here, the ECG 10 is able to supply to the modules 121, 122, . . . , 12*n* a desired voltage (for example, 12 V, 24 V, or 48 V) through a connection line 14.

As illustrated, the ECG 10 is able to perform additional functions, such as: adjustment of brightness (dimming), power-factor correction, suppression of radiofrequency interference, lighting control interface (e.g., DALI, BLE, Zigbee).

The foregoing is obtained according to criteria known to the person skilled in the art, which renders superfluous providing a more detailed description herein.

For instance, the dimming function may be obtained by means of the pulse-width-modulation (PWM) technique, for example with constant frequency (e.g., 250 Hz or 1.0 kHz), it being possible to reach very low dimming levels (e.g., 1.0% or even 0.1% with respect to the full intensity).

However, to obtain LED systems with dimming that are exempt from undesired stroboscopic effects, the new standard referred to previously (corresponding to a setting that can be defined as Human Centric Lighting, i.e., lighting centered on humans) involves the use of minimum frequencies of higher than 2.0 kHz (if the existing stroboscopic-effect visibility measure, SVM, is applied) or even higher than 2.5 kHz (if the new extended stroboscopic visibility threshold function, SVT, is applied).

As shown, the connection line 14 that transfers supply from the ECG 10 to the modules 121, 122, . . . , 12*n* may comprise a cable, the length of which may range from 0.5 to 50 m (or even higher values).

The one or more modules 121, 122, . . . , 12*n* may each comprise one or more chains or strings of LEDs and a number of electrical units connected in parallel. Each electrical unit (usually defined as "Smallest Electrical Unit" or SEU) may in turn comprise a number of LEDs in series and a current regulator for setting a desired current level, which can range from a few milliamps up to some hundreds of milliamps.

If obtained in a linear form, each module of this type can have a length that can be freely defined and customized up to 20 m.

In so-called DALI-compatible ballasts, to monitoring of the base state it is also possible to add monitoring of the load, for example for detecting a failure of the lamp, implemented by detecting periodically (for example, at intervals of less than 30 s) the variations in current for each load of the dimmer of the lamp down to low dimming levels (e.g., 5%).

The variations of load are monitored by a current-detection circuit, which, to be able to make an accurate and repeatable measurement, requires a minimum pulse ON time.

At high regulation frequencies (>2 kHz) and low dimming levels (<10%) this measurement (as exemplified in U.S. Pat. No. 9,986,608 B2) may become critical on account of the excessively short ON time.

For a solid-state source such as a LED, the light pulse emitted is proportional to the injected charge (i.e., the time integral of the forward current through the LED) during each pulse of the PWM; consequently, for a fixed current level, the light emitted increases as the duty-cycle of the pulse increases.

As is known, by "duty-cycle D of a PWM signal" is meant the ratio between the duration of the ON time $t_{ON}$ and the period of the PWM pulse, the latter being given by the sum of the duration of the ON time $t_{ON}$ and the duration of the OFF time $t_{OFF}$, i.e., $$D=t_{ON}/(t_{ON}+t_{OFF})$$

When cables and LED modules of considerable length are used (with high total current), the distributed parasitic inductances and capacitances alter the PWM signal. Consequently, the actual ON time of the more distant electrical units (the ones further to the right in FIG. 2) may be considerably reduced as compared to that of the closer first electrical units (the ones further to the left in FIG. 2). This may lead to considerable end-to-end differences of level of light emitted by the lighting system.

This effect is further exacerbated for high frequencies of PWM signal (>2.0 kHz) and low dimming levels (for example, lower than 5.0%) since the distortion of the pulse affects the ON time by a fixed amount.

One or more embodiments may exploit the frequency modulation (FM) of the PWM signal: for a given dimming level, the duty-cycle of the PWM signal remains constant, whereas its frequency is varied, with an approach that can be defined as FM-PWM.

In one or more embodiments, the modulating frequency of the PWM signal and the frequency shift can be set in such a way as to obtain a reduction of the total sum of the harmonics expressed by the Minkowski relation referred to previously so as to be able to remain below the limit defined by the regulation.

This mode of procedure is based upon the spread of the energy over a relatively wide frequency range or spectrum.

Thanks to the fact that the exponent of the Minkowski relation used is greater than 2 (it is 3.7), the re-summation of the spectral components returns a value lower than the same spectral power in the presence of fixed (non-modulated) frequency of the PWM signal.

Albeit not wishing to be tied down, in this connection, to a particular analytical approach, it has been noted that the modulating waveform can perform an important role in reducing the final value that can be defined with the Minkowski relation.

Figure 5A:
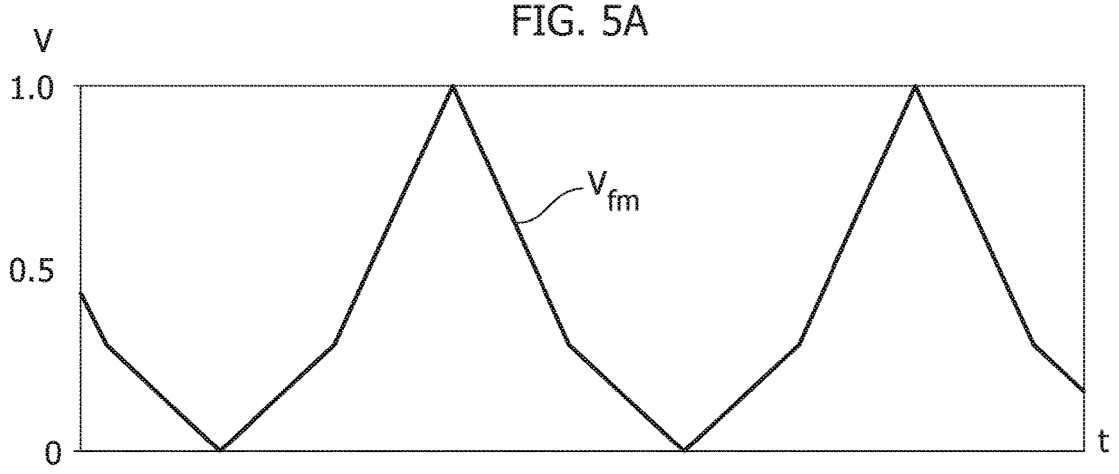
FIGS. 5A and 5B represent possible plots of signals that can be used according to some embodiments.
Figure 5B:
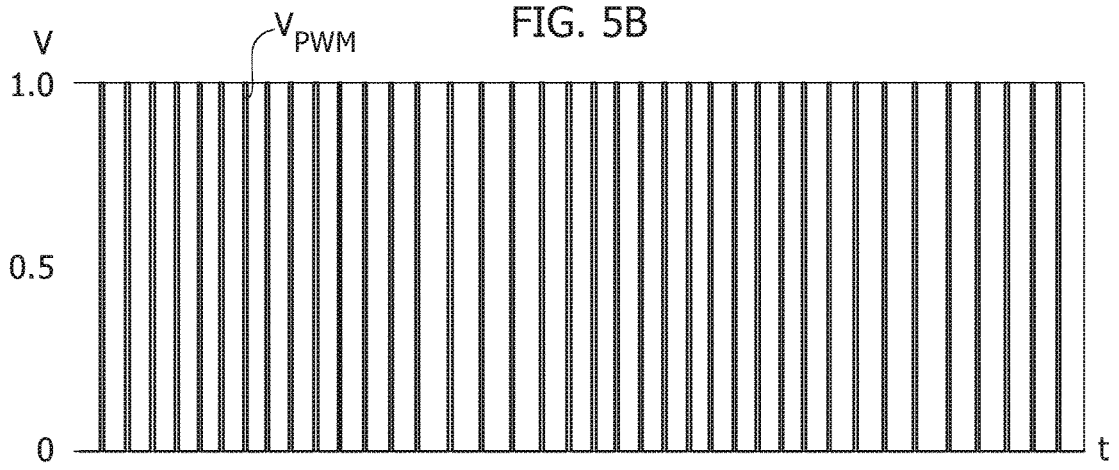

For instance, as discussed in what follows in relation to FIGS. 5A and 5B, it may be noted how it is advantageous to use modulation profiles that are triangular nor sinusoidal, it being possible to identify customized modulation waveforms that are able to improve the final result in terms of SVM.

A possible concept to be taken into account in defining a modulation (for example, a non-uniform one) is to obtain a greater advantage from the weighting law by identifying the highest harmonic content of energy, where the stroboscopic visibility threshold is higher (hence with a lower weight in the calculation of the SVM value).

It has been noted that, for example, a frequency shift of 300 Hz around a central frequency of 1700 Hz, leads to a very good final SVM value (<0.4) even with uniform (triangular) modulation and in the presence of low dimming levels (lower than 10%).

Of course, the values referred to merely have the purpose of pinning down our ideas, without any intention of limiting the embodiments.

In general, it has been found to be useful, in identifying advantageous solutions of frequency modulation of the PWM signal, to take into account one or more of the following criteria:

keeping the average frequency as low as possible to improve uniform distribution of the light along the system (an aspect linked to the length of the cable 14 and of the modules 121, 122, . . . , 12*n*);

maintaining the modulated frequency below a certain value for a time sufficiently long to enable measurement of the load, for example with the pulse-shift solution described in U.S. Pat. No. 9,986,608 B2 (already cited); this facilitates detection of possible failures of the lighting modules (for example, 121, 122, 12n) in compliance with the specifications of a DALI environment;

advantageously preventing generation, in the FM-PWM process, of harmonics lower than 100 Hz: this facilitates maintaining the other TLA parameter, i.e., $P_{st}$, the metric of which is based upon the lower frequency bands;

seeking to shift, in an equally advantageous way, the harmonic content where the weighting coefficient is low; together with the criteria seen previously, this means remaining in the higher part of the spectrum (1 kHz<f<2 kHz) as long as this is possible.

In what follows, some examples of possible waveforms are presented that can be used for modulating the frequency of a PWM signal.

Figure 3A:
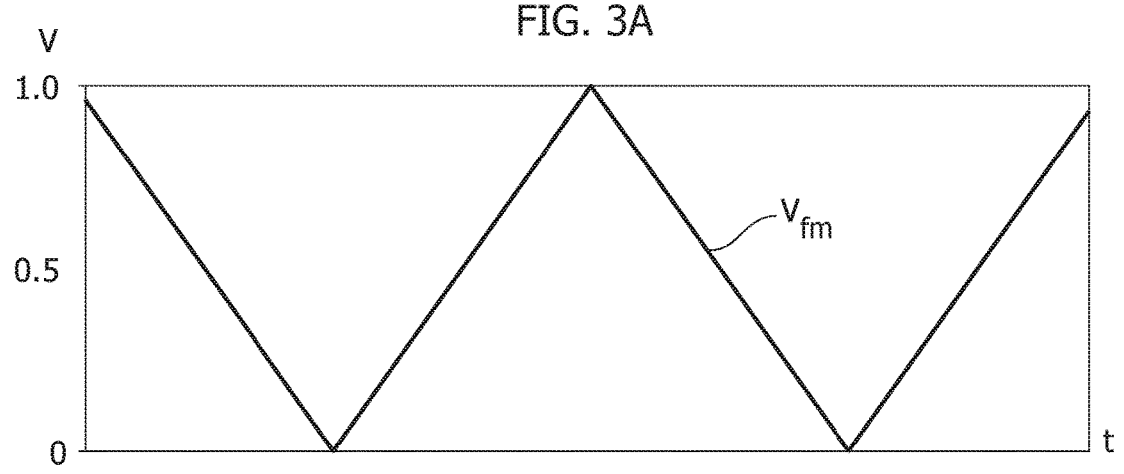
FIGS. 3A and 3B represent possible plots of signals that can be used in solutions described herein.
Figure 3B:
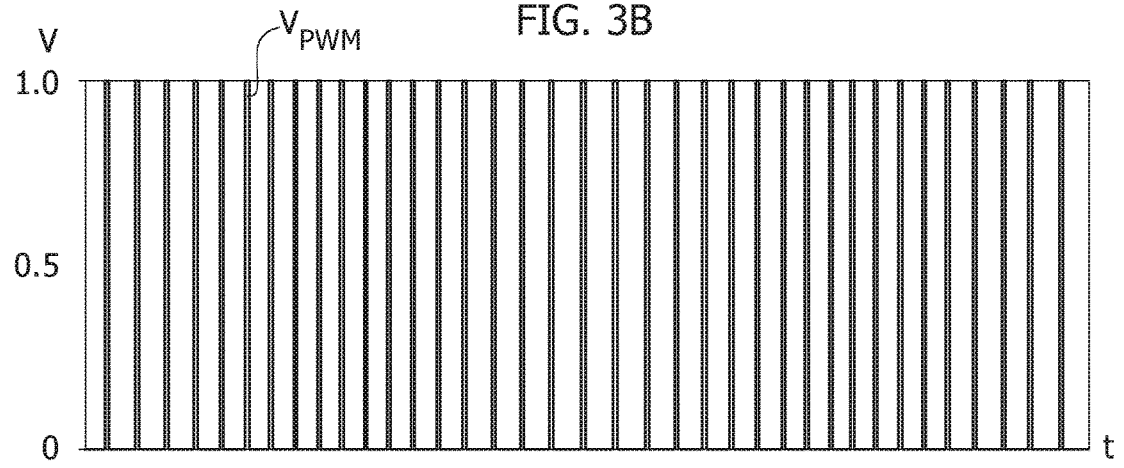

As a reference example, FIG. 3A exemplifies a modulating waveform $V_{fm}$ with a triangular envelope having its amplitude normalized between 0 V and 1 V, which provides a frequency modulation of a PWM signal, as represented by way of example in FIG. 3B: this is a rectangular-wave signal with a duty-cycle equal to 10% (which also has an amplitude normalized between 0 V and 1 V), the frequency of which varies, as a result of modulation, in the range 1700+/−300 Hz.

It will be appreciated that, with the modalities exemplified in FIGS. 3A and 3B:

"low" values of the modulating signal $V_{fm}$ of FIG. 3A correspond to a smaller distance between the pulses of the PWM signal, and hence to a reduction of the period and to an increase of the frequency of the PWM signal of FIG. 3B; and "high" values of the modulating signal $V_{fm}$ of FIG. 3A correspond to a greater distance between the pulses of the PWM signal, and hence to an increase of the period and to a reduction of the frequency of the PWM signal of FIG. 3B.

This choice has of course a purely exemplary and non-limiting nature.

Figure 4:
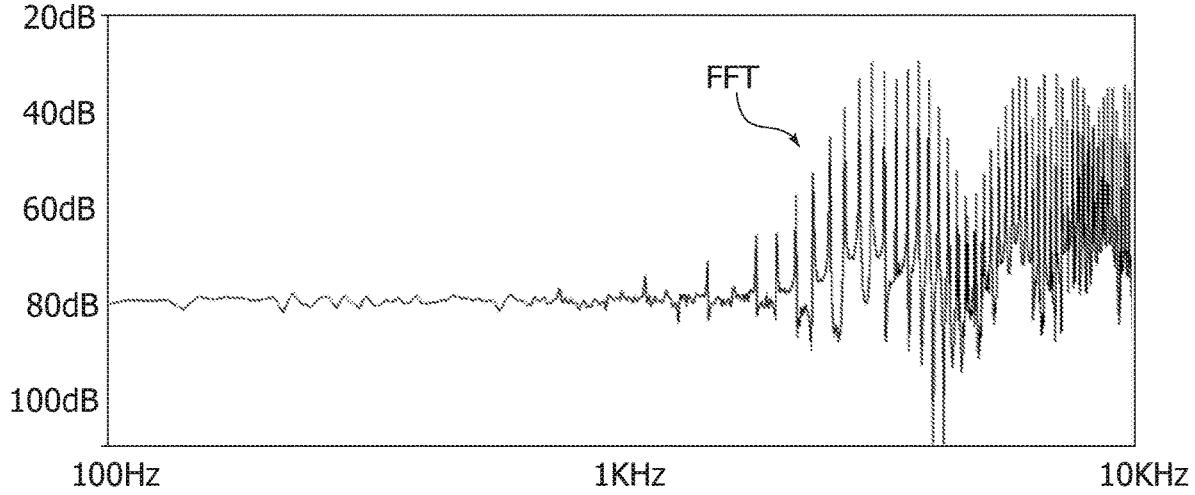
FIG. 4 exemplifies a possible plot of the Fast Fourier Transform (FFT) of a signal produced according to the criteria exemplified in FIGS. 3A and 3B.

The diagram of FIG. 4 represents a possible resulting FFT. It has been found that recourse to an FM-PWM technique (in practice, a technique of spread-spectrum modulation, in this case with uniform spread) facilitates achievement of a reduced value of SVM, as desired.

As an example of some embodiments, FIG. 5A exemplifies a modulating waveform $V_{fm}$, also here with an amplitude normalized between 0 V and 1 V, which provides a frequency modulation of a PWM signal between a minimum value and a maximum value, as represented by way of example in FIG. 5B.

Also in this case, this is a rectangular-wave signal with duty-cycle equal to 10% (also this has an amplitude normalized between 0 V and 1 V), the frequency of which also in this case varies, as a result of modulation, between a maximum value and a minimum value in the range 1700+/−300 Hz.

In the case exemplified in FIGS. 5A and 5B, the modulating waveform $V_{fm}$ does not present a symmetrical triangular plot, as in the case of FIG. 3A, where the modulating signal $V_{fm}$ has (this choice being, moreover, non-imperative) rising and falling edges with constant angular coefficient (that is the same, but for the sign, which is positive for the rising edges and negative for the falling edges).

In the case exemplified in FIGS. 5A and 5B, the modulating waveform $V_{fm}$ has, instead, a plot (which may be defined as a sort of "mixed" triangular plot), where:

the rising edges initially have a first value of angular coefficient, which is followed, when a value of approximately 0.3 V is reached (i.e., below the half-amplitude value of 0.5 V), by a second value of angular coefficient, higher than the first; i.e., the slope is steeper;

the falling edges have a symmetrical plot (also but for the positive and negative sign, for the rising and falling edges) and initially have an angular coefficient corresponding to a steeper slope, which is followed by an angular coefficient corresponding to a gentler slope, also in this case when the falling edge reaches a value of approximately 0.3 V (i.e., below the half-amplitude value of 0.5 V, which corresponds to a value of the frequency of the frequency-modulated PWM signal equal to the average between the minimum value and the maximum value of the frequency resulting from the modulation).

Also in the case exemplified in FIGS. 5A and 5B, the modulating signal $V_{fm}$ has (this choice being, moreover, non-imperative) rising and falling edges with symmetrical variations of angular coefficient (but for the sign, which is positive for the rising edges and negative for the falling edges).

Also in the case of the modalities exemplified in FIGS. 5A and 5B:

"low" values of the modulating signal $V_{fm}$ of FIG. 5A correspond to a shorter distance between the pulses of the PWM signal, and hence to a reduction in the period and an increase in the frequency of the PWM signal of FIG. 5B; and "high" values of the modulating signal $V_{fm}$ of FIG. 5A correspond to a greater distance between the pulses of the PWM signal, and hence to an increase in the period and a reduction in the frequency of the PWM signal of FIG. 5B.

Of course also in this case, the above choice has a purely exemplary and non-limiting character.

This applies also to the more or less steep triangular waveform (with double slope) represented in FIG. 5A.

The above waveform is an example that simplifies understanding of the fact that, as precisely exemplified in FIGS. 5A and 5B, the alternation of the two values of angular coefficient below the half-amplitude value (approximately 0.5 V) takes into account the fact that, where the slope of the modulating signal is steeper (both in the rising edge and in the falling edge) the modulating signal $V_{fm}$ varies more rapidly as compared to where the slope of the modulating signal is gentler (also here both in the rising edge and in the falling edge).

In this way, it is possible to modulate the frequency of the pulse-width-modulated signal $V_{PWM}$ maintaining the pulse-repetition frequency of the pulse-width-modulated signal $V_{PWM}$ between the value around which the modulation is performed and the highest (maximum) frequency value for times longer than the ones during which the pulse-repetition frequency of the pulse-width-modulated signal $V_{PWM}$ is kept between the value around which the modulation is performed and the lowest (minimum) frequency value.

This fact may be appreciated from the example of FIG. 5A, bearing in mind that in this figure "low" values of the modulating signal $V_{fm}$ correspond to an increase in the frequency of the PWM signal, whereas "high" values of the modulating signal $V_{fm}$ correspond to a reduction in the frequency of the PWM signal, with the half-amplitude value (for example, 0.5 V) corresponding to a value of the frequency of the frequency-modulated PWM signal equal to the average between the minimum value and the maximum value of the frequency resulting from modulation.

In the example of FIG. 5A, the time intervals during which the modulating signal $V_{fm}$ lies below the half-amplitude value, i.e., during which the frequency of the modulated signal falls between the value around which the modulation is performed and the highest (maximum) frequency value are longer than the time intervals during which the modulating signal $V_{fm}$ lies above the half-amplitude value, i.e., for which the frequency of the modulated signal falls between the value around which the modulation is performed and the lowest (minimum) frequency value.

The aim of the foregoing is to shift the harmonic content where the weighting coefficient is low, seeking to remain in the higher part of the spectrum as long as possible.

It has been noted that the adoption of a non-uniform modulation profile distributes the spectrum differently so as to concentrate more energy where the energy has a lower weight.

Figure 6:
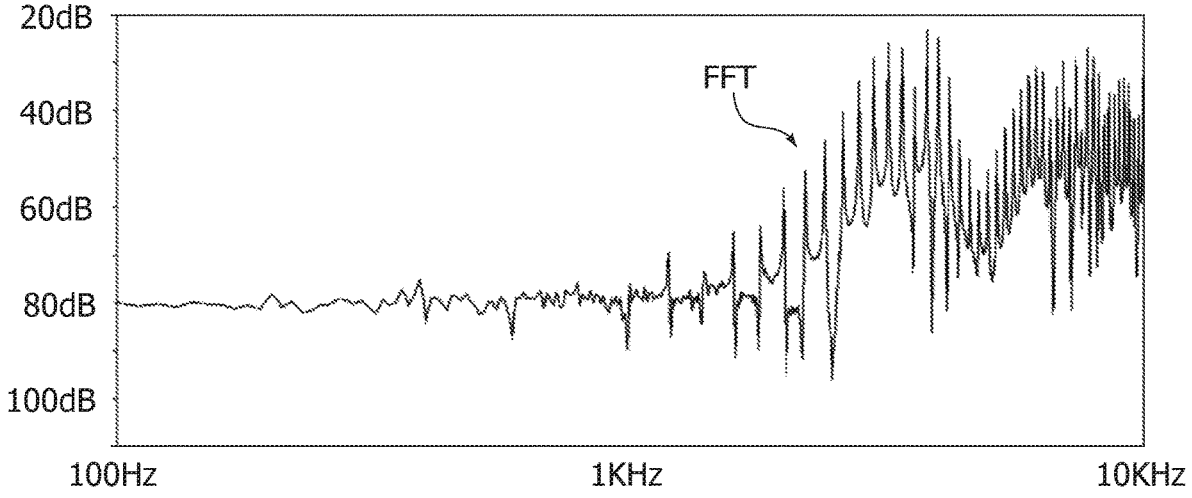
FIG. 6 exemplifies a possible plot of the Fast Fourier Transform (FFT) of a signal produced according to the criteria exemplified in FIGS. 5A and 5B.

The diagram of FIG. 6 represents a possible FFT resulting from the application of the FM-PWM criteria exemplified in FIGS. 5A and 5B (which also in this case is a non-uniform spread-spectrum modulation technique) facilitates achievement of an SVM value further reduced as compared to the uniform spectrum-spread modulation exemplified in FIGS. 3A and 3B.

Figure 7:
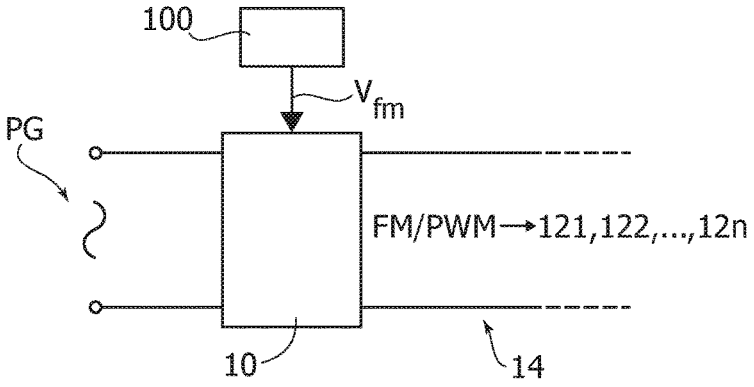
FIG. 7 is a block diagram exemplifying a lighting system according to some embodiments.

The block diagram of FIG. 7 exemplifies the possibility of integrating, in a lighting system that is as a whole equivalent to the system illustrated in FIG. 2, a function of frequency modulation of the PWM signal generated by the ECG 10 via a modulating signal $V_{fm}$ that enables the "carrier" frequency of the PWM signal to vary, causing variation of the pulse-repetition period of the PWM signal even given the same duty-cycle value.

It will be appreciated that the intensity of the luminous flux emitted continues to be determined chiefly by the aforesaid duty-cycle value, seeing that the frequency modulation of the PWM signal is performed around an average value and in a range of frequencies (for example, 1700 Hz+/−300 Hz) such as not to have a perceivable effect on the time integral of the forward current through the LED.

For instance, the FM-PWM exemplified herein can be performed by configuring (in a way in itself known to persons skilled in the sector) the ECG 10 with a function of voltage-controlled oscillator (VCO) that can be driven in frequency modulation by a signal $V_{fm}$ produced by a modulator circuit 100 (which is illustrated in FIG. 7 as a distinct element, but may be integrated in the ECG 10).

In one or more embodiments, the modulator circuit 100 may be obtained in the form of a programmable circuit, which is able to generate different frequency-modulation signals $V_{fm}$, which can be selected, for example, according to different requirements of application and use.

In this regard, it will be appreciated that block 10 and block 100, here illustrated as distinct elements for simplicity of explanation, may be obtained as a single entity, for example as a programmable digital machine (microcontroller), which is able to exploit peripherals (timers) to obtain the operation described.

It will likewise be appreciated that reference to a CV SSL system (see FIGS. 2 and 7) is provided purely by way of non-limiting example of the embodiments: albeit having been developed with particular attention paid to lighting systems of this nature, one or more embodiments are advantageously suited to use in lighting systems of a different type, such as constant-current (CC) systems.

Figure 8:
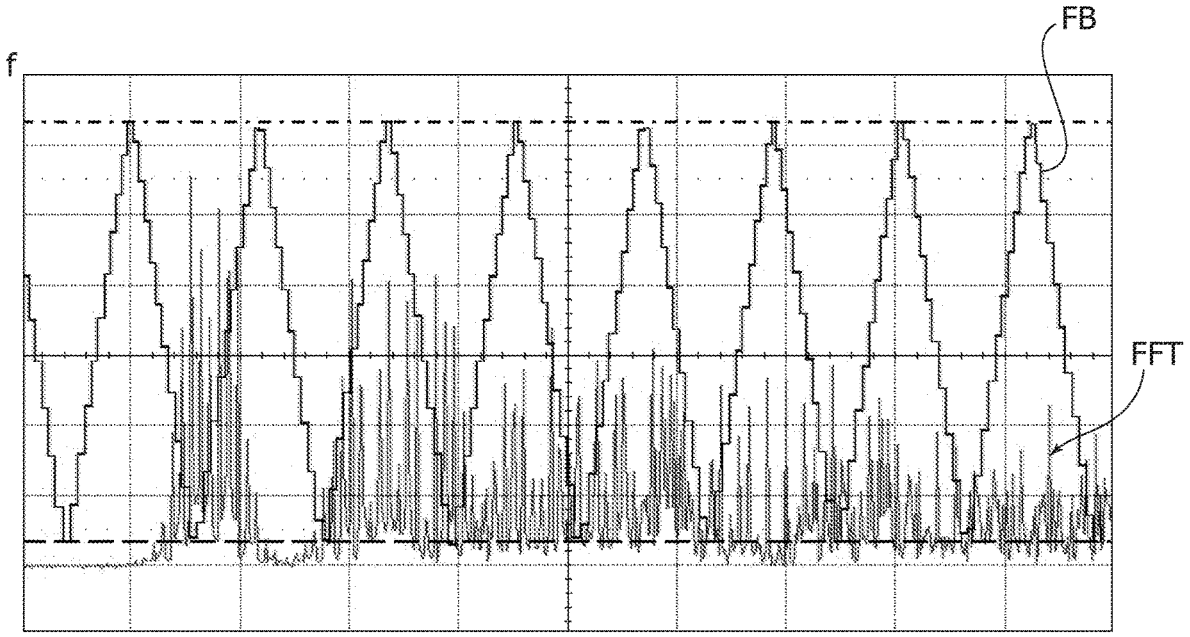
FIG. 8 exemplifies possible plots of signals in embodiments according to the present description.

In this regard, the diagram of FIG. 8 exemplifies a possible frequency plot FB of a signal subjected to FM-PWM in the terms discussed here, and a possible plot of a corresponding Fast Fourier Transform, which are such as to give rise to an SVM value equal to 0.399.

A method like the one exemplified herein may consequently comprise:

driving (for example, 10) at least one electrically powered light source (for example, 121, 122, . . . , 12*n*) by applying thereto a pulse-width-modulated signal (for example, $V_{PWM}$) having a pulse-repetition frequency and a duty-cycle, the duty-cycle being selectively variable in order to vary the intensity of light emitted by said at least one electrically supplied light source; and frequency modulating (for example, 100, $V_{fm}$) the pulse-width-modulated signal by varying the pulse-repetition frequency thereof around a certain value between a lower frequency value and a higher frequency value.

A method as exemplified herein may consequently comprise recourse to a mixed FM/PWM modulation, substantially resembling a spread-spectrum technique applied to the PWM signal.

In a method as exemplified herein, the higher frequency value may be around 2 kHz (for example, from 2 to 2.1 kHz), which on the one hand makes it possible to avoid non-uniformity of lighting of an end-to-end type and, on the other hand, facilitates detection of failures.

In a method like the one exemplified herein, the aforesaid frequency modulation (for example, 100, $V_{fm}$) between said lower frequency value and said higher frequency value can occur with non-uniform frequency variation.

A solution of this type is exemplified in FIG. 5A, where the pulse-repetition frequency may be seen to vary (also here with opposite signs for the rising and falling edges) with:

a first rate of variation in a first frequency range between said lower frequency value and said higher frequency value; and a second rate of variation in a second frequency range between said lower frequency value and said higher frequency value, the foregoing with the first rate of variation different from the second rate of variation, and the first frequency range different from the second frequency range.

Of course, the law of "broken-line" variation illustrated in FIG. 5A is just one possible example of a law of non-uniform frequency variation.

In one or more embodiments, this variation may occur with a law of variation represented by a different curve, which may also be differentiatable, for example a hyperbole or a parabola or, possibly, a curve defined by tabulated points, obtained experimentally or via simulation.

In a method as exemplified herein, the aforesaid certain value may be approximately 1700 Hz.

A method as exemplified herein may comprise modulating the frequency of the pulse-width-modulated signal, maintaining the pulse-repetition frequency of the pulse-width-modulated signal between said certain value and said higher frequency value (i.e., in a higher frequency range: see, in FIG. 5A, the time intervals during which the modulating signal $V_{fm}$ lies below the half-amplitude value, i.e., during which the frequency of the modulated signal falls between the average value around which the modulation is performed and the highest or maximum frequency value) for times longer than the times during which the pulse-repetition frequency of the pulse-width-modulated signal is kept between said certain value and said lower frequency value (i.e., in a lower frequency range: see, in FIG. 5A, the time intervals during which the modulating signal $V_{fm}$ lies above the half-amplitude value, i.e., during which the frequency of the modulated signal falls between the average value around which the modulation is performed and the highest or maximum frequency value).

A driver circuit (for example, a so-called ECG 10) as exemplified herein may be configured to apply to at least one electrically powered light source a pulse-width-modulated signal having a pulse-repetition frequency and a duty-cycle, the duty-cycle being selectively variable in order to vary the intensity of light emitted by said at least one electrical light source.

Such a driver circuit may be configured for frequency modulating the pulse-width-modulated signal by varying the pulse-repetition frequency thereof around a certain (average) value between a lower frequency value and a higher frequency value with the method as exemplified herein.

A driver circuit as exemplified herein may comprise a frequency modulator (for example, 100) configured to produce a plurality of different frequency-modulation signals for modulating the pulse-width-modulated signal by varying the pulse-repetition frequency thereof around said certain value between said lower frequency value and said higher frequency value.

A lighting system as exemplified herein may comprise:

a driver circuit as exemplified herein; and at least one electrically powered light source coupled (for example, via a line or cable 14) to said driver circuit to have applied thereto said pulse-width-modulated signal having the pulse-repetition frequency thereof that varies around a certain value between a lower frequency value and a higher frequency value.

In a lighting system as exemplified herein, the at least one electrically powered light source may comprise a solid-state light source, optionally a LED light source.

Without prejudice to the underlying principles, the details of construction and the embodiments may vary, even significantly, with respect to what has been illustrated herein purely by way of non-limiting example, without thereby departing from the sphere of protection, which is defined by the annexed claims.

LIST OF REFERENCE SIGNS

I (existing) contrast threshold
II (new) contrast threshold
PG electric power grid
10 driver circuit (ECG)
100 modulator
121, 122, . . . 12*n* LED modules
14 connection line (cable)
$V_{fm}$ frequency-modulating signal
$V_{PWM}$ PWM signal
FB FM-PWM signal
FFT Fast Fourier Transform

The invention claimed is:

1. A method, comprising:

driving at least one electrically powered light source applying thereto a pulse width modulated signal having a pulse repetition frequency and a duty-cycle;

selectively varying the duty cycle of the pulse width modulated signal to vary the light intensity emitted by the at least one electrically powered light source; and frequency modulating the pulse width modulated signal varying the pulse repetition frequency thereof around a certain value between a lower frequency value and an upper frequency value;

wherein the method comprises frequency modulating the pulse width modulated signal varying the pulse repetition frequency thereof between the lower frequency value and the upper frequency value with a non-uniform frequency variation keeping the pulse repetition frequency of the pulse width modulated signal between said certain value and said upper frequency value for times longer than the times the pulse repetition frequency of the pulse width modulated signal is kept between said certain value and said lower frequency value.

2. The method of claim 1, wherein the upper frequency value is about 2 kHz.

3. The method of claim 1, wherein said certain value is approximately 1700 Hz.

4. The method of claim 1, wherein said certain value is the average value of said upper frequency value and said lower frequency value.

5. A driver circuit configured to apply to at least one electrically powered light source a pulse width modulated signal having a pulse repetition frequency and a duty-cycle, wherein the driver circuit is configured to selectively vary the duty-cycle of the pulse width modulated signal to vary the light intensity emitted by the at least one electrically powered light source; wherein the driver circuit is configured to frequency modulate the pulse width modulated signal varying the pulse repetition frequency thereof around a certain value between a lower frequency value and an upper frequency value with the method of claim 1.

6. The driver circuit of claim 5, further comprising a frequency modulator configured to produce a plurality of different frequency modulation signals to frequency modulate the pulse width modulated signal varying the pulse repetition frequency thereof around said certain value between said lower frequency value and said upper frequency value.

7. A lighting system, comprising:

a driver circuit according to claim 5, and at least one electrically powered light source coupled to said driver circuit to have applied thereto said pulse width modulated signal having the pulse repetition frequency thereof varying around a certain value between a lower frequency value and an upper frequency value.

8. The lighting system of claim 7, wherein said at least one electrically powered light source comprises a solid state light source.

9. The lighting system of claim 8, wherein said at least one electrically powered light source comprises a LED light source.

* * * * *